US008215974B2

(12) United States Patent
Lau et al.

(10) Patent No.: US 8,215,974 B2
(45) Date of Patent: Jul. 10, 2012

(54) POWER PLUG AND POWER PLUG ASSEMBLY

(75) Inventors: Choon-Tyng Lau, Taipei Hsien (TW); Yi-Fang Wu, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 244 days.

(21) Appl. No.: 12/620,094

(22) Filed: Nov. 17, 2009

(65) Prior Publication Data

US 2011/0028042 A1 Feb. 3, 2011

(30) Foreign Application Priority Data

Jul. 28, 2009 (CN) ..... 2009 1 0304899

(51) Int. Cl.
*H01R 31/06* (2006.01)

(52) U.S. Cl. ..... 439/176; 439/172; 439/528

(58) Field of Classification Search ..... 439/628, 439/638, 176, 518, 349, 651, 131, 172, 528
See application file for complete search history.

(56) References Cited

U.S. PATENT DOCUMENTS

| | | | | |
|---|---|---|---|---|
| 5,648,712 | A * | 7/1997 | Hahn | 320/111 |
| 6,320,353 | B1 * | 11/2001 | Chiu et al. | 320/111 |
| 7,168,968 | B1 * | 1/2007 | Li | 439/172 |
| 7,241,169 | B1 * | 7/2007 | Yang et al. | 439/518 |
| 2009/0117765 | A1 * | 5/2009 | Wen et al. | 439/166 |

* cited by examiner

*Primary Examiner* — Tulsidas C Patel
*Assistant Examiner* — Travis Chambers
(74) *Attorney, Agent, or Firm* — Altis Law Group, Inc.

(57) ABSTRACT

A power plug is configured for connecting a power adaptor to a power supply socket. The power plug includes a first portion and a second portion. At least two prongs are disposed on the first portion and are capable of being coupled to the power supply socket. The second portion is configured to be electrically coupled to the power adaptor. The second portion defines a receiving housing capable of accommodating the power adaptor.

4 Claims, 6 Drawing Sheets

POWER PLUG AND POWER PLUG ASSEMBLY

BACKGROUND

1. Technical Field

The present disclosure relates to power plugs configured to electronically connect an electronic device to a power supply socket.

2. Description of Related Art

Power plugs are generally used to connect an electronic component to a power supply socket. For example, typically, a notebook includes a power adapter connected to the power supply socket via the power plug, so as to provide power to the notebook. However, conventional power plugs generally include a cable, and the power adapter is connected to the power plug via the cable.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
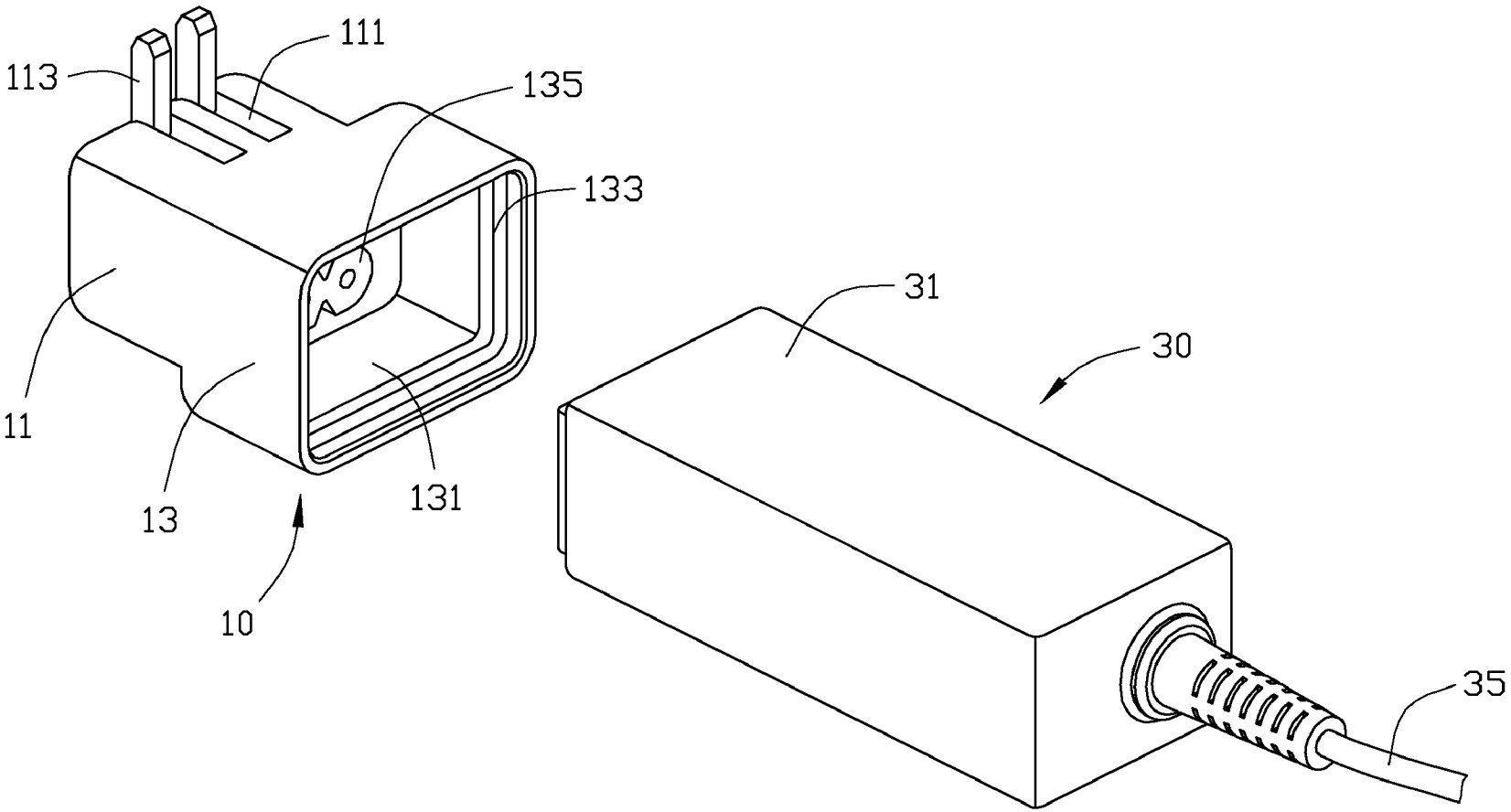
FIG. 1 is an exploded, isometric view of a power plug and a power adaptor in accordance with an embodiment.
Figure 2:
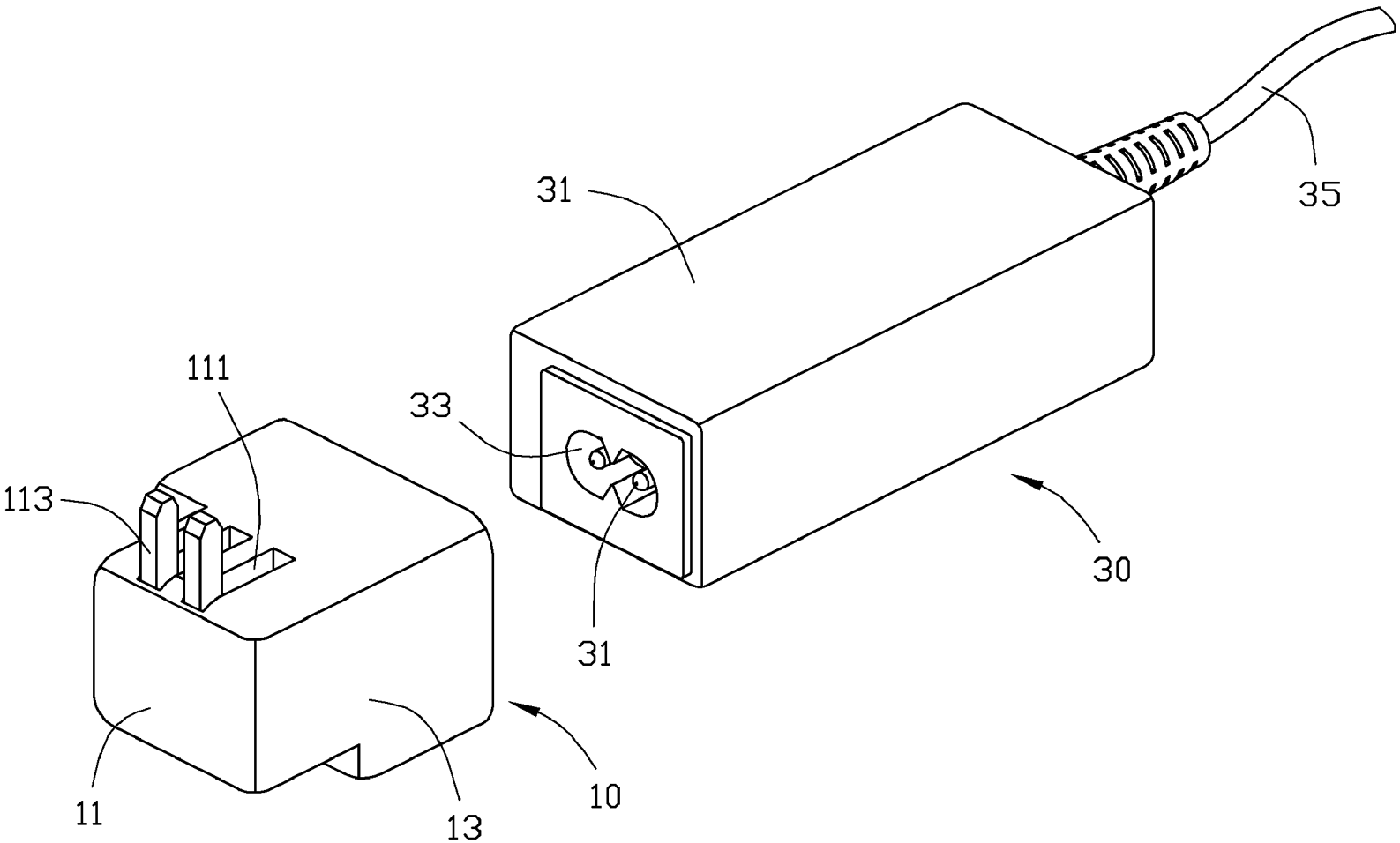
FIG. 2 is similar to FIG. 1, but viewed in another aspect.
Figure 3:
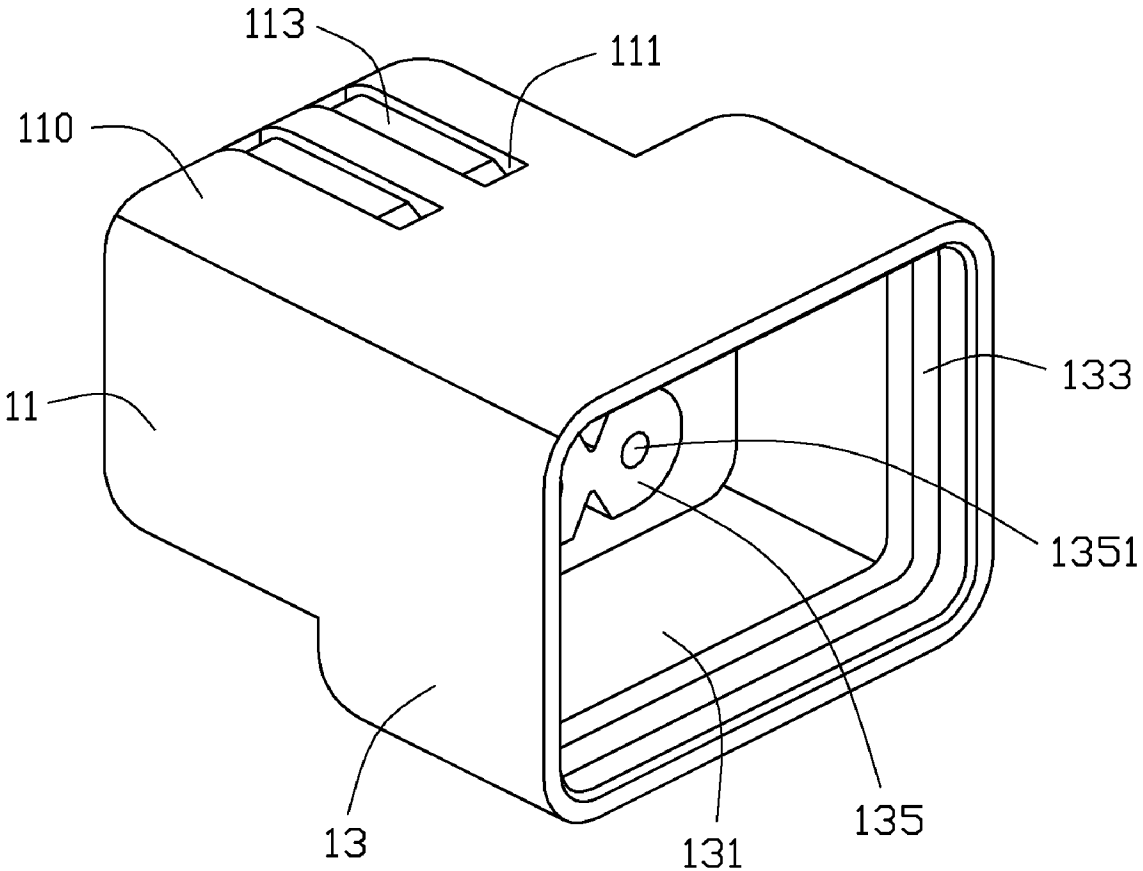
FIG. 3 is an isometric view of the power plug of FIG. 1, with two prongs received in two receiving slots in the power plug.

Referring to FIGS. 1-3, a power plug 10 is provided to electronically connect a power adaptor 30 to a power supply socket 50 (see FIGS. 5-6), to supply power to an electronic device 60 (see FIG. 6) coupled with the power adaptor 30. The power adapter 30 is configured to convert alternating current (AC) voltage to working voltage for the electronic device 60.

The power adaptor 30 includes a rectangular base 31. One end of the base 31 defines two mounting holes 33. A connecting pin 331 is disposed in each mounting hole 33. A cable 35 extends from an opposite end of the base 31.

The power plug 10 includes a first portion 11 and a second portion 13. The first portion 11 has a flat top surface 110. Two longitudinal receiving slots 111 are defined in the top surface 110. Two prongs 113 are rotatably disposed in the two receiving slots 111. The two prongs 113 are capable of being accommodated in the two receiving slots 111 and being rotated out of the receiving slots 111 and located in a position perpendicular to the flat top surface 110 of the first portion 11. When the two prongs 113 are perpendicular to the flat top surface 110 of the first portion 11, the prongs 113 are capable of being connected to the power supply socket 50 to establish electrical connection between the power plug 10 and the power supply socket 50.

The second portion 13 of the power plug 10 is integrally formed with the first portion 11. The second portion 13 defines a substantially receiving housing 131 configured for receiving one end of the power adaptor 30. The receiving housing 131 has an internal periphery, which substantially fits a profile of the power adapter 30. A retaining member 133 is disposed around the internal periphery of the receiving housing 131, and is configured to strengthen the attachment between the power adaptor 30 and the power plug 10 when the power adaptor 30 is inserted into the receiving housing 131 of the power plug 10. In one embodiment, the retaining member 133 is made of resilient material, such as rubber. Two protrusions 135 extend from the receiving housing 131. Each protrusion 135 defines a receptacle hole 1351 corresponding to the connecting pins 331 of the power adaptor 30.

Figure 4:
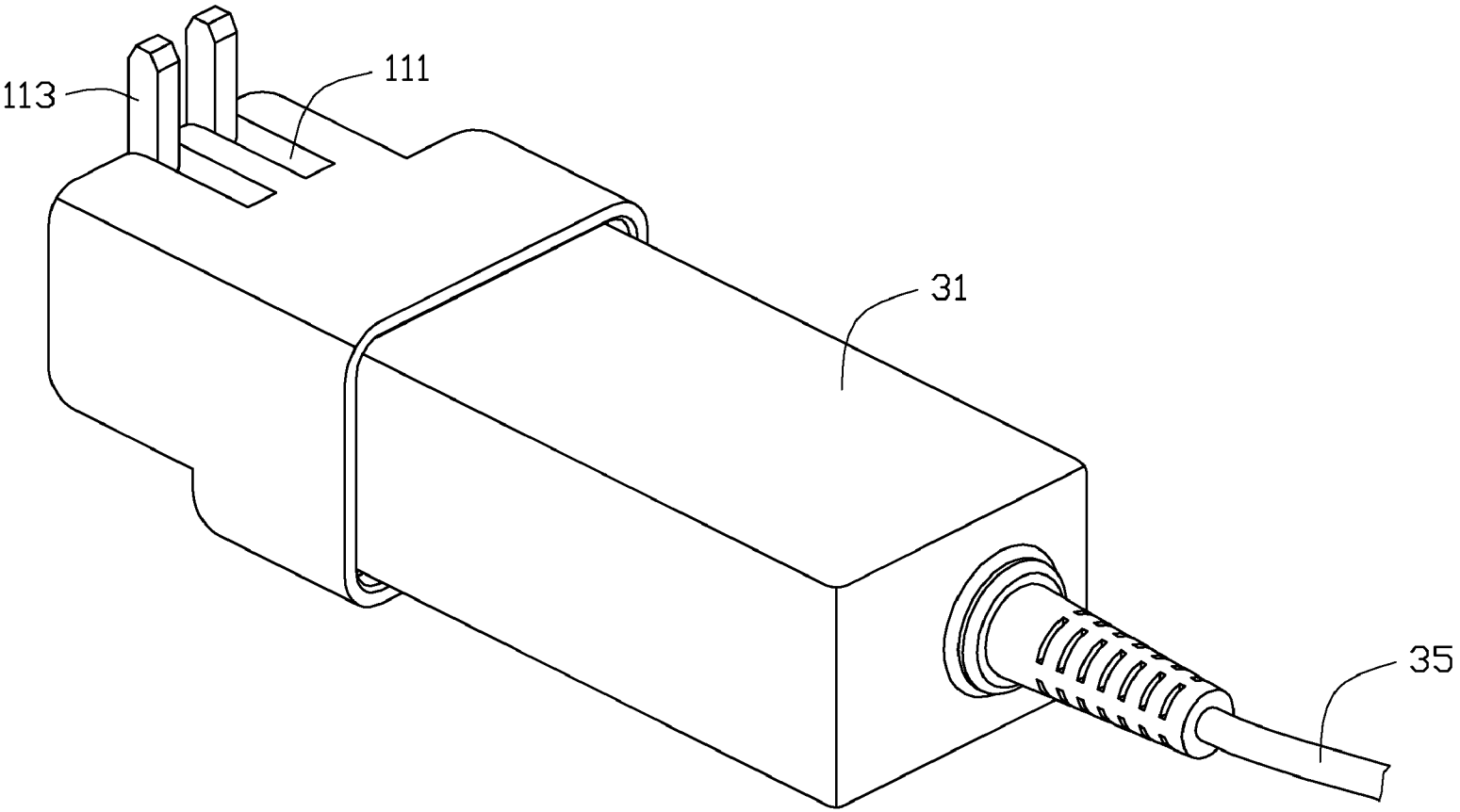
FIG. 4 is an assembled view of FIG. 1.
Figure 5:
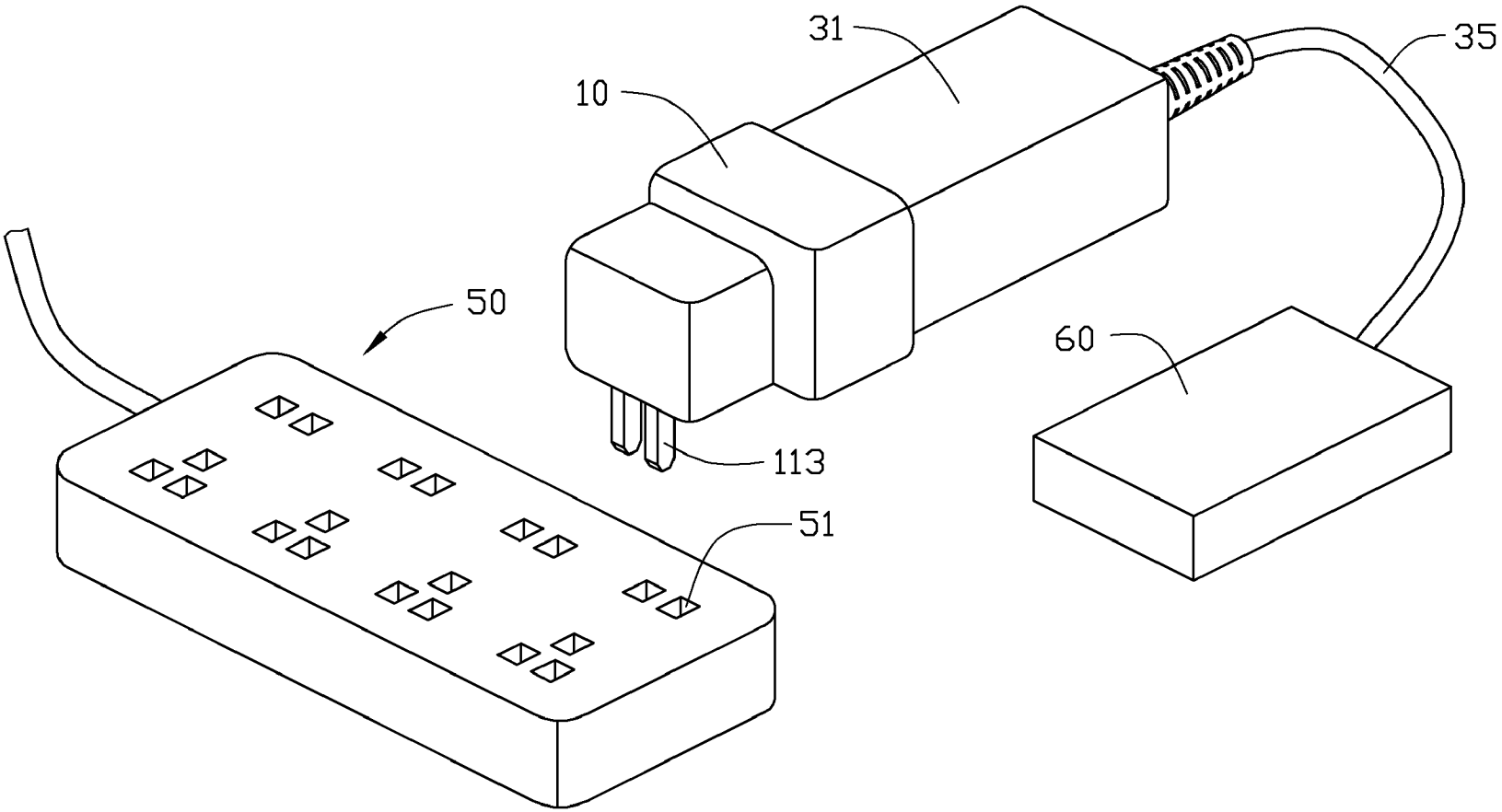
FIG. 5 is an exploded, isometric view of a power supply socket and the power adapter and the power plug of FIG. 4.
Figure 6:
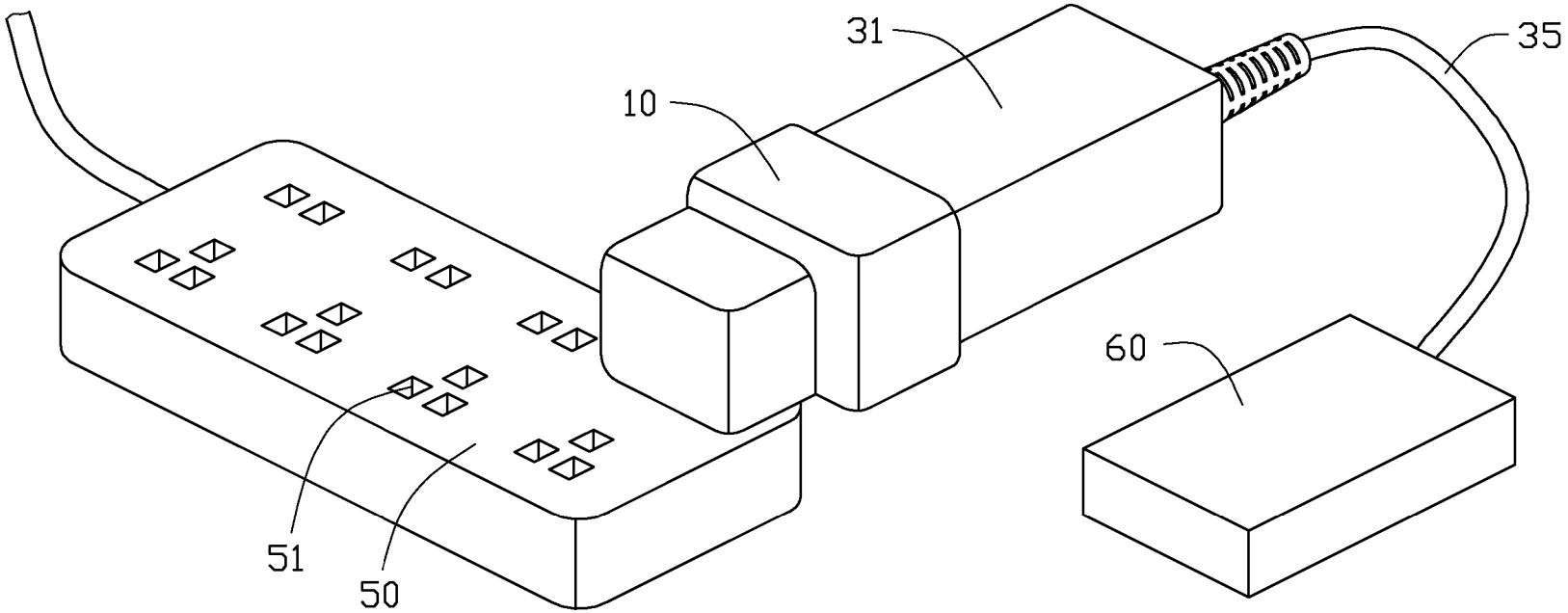
FIG. 6 is an assembled view of FIG. 5 including an electronic device.

Referring to FIGS. 4-6, when in use, the power adapter 30 is inserted into the receiving housing 131 of the power plug 10. The mounting holes 33 accommodate the protrusions 135 of the power plug 10, and the connecting pins 331 are inserted in the receptacle holes 1351 of the protrusions 135. Thus, the power adapter 30 is connected to the power plug 10. The retaining member 133 of the power plug 10 wraps around an external periphery of the power adapter 30. Then, the two prongs 113 of the power plug 10 are rotated out from a first position where the prongs 113 are received in the receiving slots 111 to a second position where the prongs 113 are perpendicular to the top surface 110 of the power plug first portion 11. The prongs 113 are inserted into two power socket holes 51 to electrically connect the power adapter 30 to the power supply socket 50, so as to provide power to the electronic device 60.

When the power plug 10 is not in use, the two prongs 113 may be rotated into the receiving slots 111 of the power plug 10. The power adapter 30 is directly received in the receiving house 131 of the power plug 10. When compared with the conventional power plug, no cable is needed to electronically connect the power plug 10 and the power adaptor 30. The power plug 10 and the power adapter 30 are also easier to transport.

It is to be understood, however, that even though numerous characteristics and advantages of the embodiments have been set forth in the foregoing description, together with details of the structure and function of the present disclosure, the disclosure is illustrative only, and changes may be made in detail, especially in matters of shape, size, and arrangement of parts within the principles of the embodiments to the full extent indicated by the broad general meaning of the terms in which the appended claims are expressed.

What is claimed is:

1. A power plug assembly, comprising:

an electronic component configured to convert voltage from a power supply socket into working voltage for an electronic device; and a power plug comprising a first portion capable of being coupled to the power supply socket, and a second portion electrically connected to the electronic component; the second portion comprising a receiving housing and a retaining member; wherein the retaining housing is adapted to receive a portion of the electronic component and comprises a rectangular internal periphery; the retaining member is attached to an inner surface of the rectangular internal periphery, to strengthen an attachment between the electronic component and the power plug;

wherein at least two receptacle holes capable of electrically connected to the electronic component are defined in the receiving housing of the second portion;

wherein two protrusions extend from the first portion of the plug and are located in the receiving housing, the receptacle holes are defined in the protrusions.

2. The power plug assembly of claim 1, wherein the electronic component defines two mounting holes, the two protrusions are accommodated in the mounting holes.

3. The power plug assembly of claim 2, wherein two connecting pins are arranged in the mounting holes of the electronic component, and the connecting pins are coupled with the receptacle holes.

4. The power plug assembly of claim 2, wherein the retaining member is made of rubber.

* * * * *